United States Patent [19]

Nanasi

[11] 4,310,953

[45] Jan. 19, 1982

[54] JEWELRY CLASP

[76] Inventor: John Nanasi, 35 Jones Rd., Englewood, N.J. 07631

[21] Appl. No.: 64,854

[22] Filed: Aug. 8, 1979

[51] Int. Cl.[3] ..... A44B 19/00

[52] U.S. Cl. ..... 24/230 AL

[58] Field of Search ..... 24/230 AK, 230 AL, 239, 24/241 SL

[56] References Cited

U.S. PATENT DOCUMENTS 3,522,640 8/1970 Lohr ..... 24/230 AL 3,969,795 7/1976 Stephenson ..... 24/230 AL

FOREIGN PATENT DOCUMENTS 738989 10/1955 United Kingdom ..... 24/230 AL

*Primary Examiner*—William H. Schultz

*Attorney, Agent, or Firm*—Jacobs & Jacobs

[57] ABSTRACT

A jewelry clasp comprises a spring-loaded member normally closing a slot, the member being provided with a cam surface operable to move the member out of the slot when a jump ring is pushed into the slot against the cam surface.

2 Claims, 3 Drawing Figures

JEWELRY CLASP

The present invention relates to a jewelry clasp, particularly those used on necklaces.

There have been many jewelry clasps proposed in the art for necklaces, but they all require great manual dexterity to operate the clasp while the clasp is behind the neck of the person and thus out of sight. This can be a great disadvantage to those having less than perfect manual dexterity, e.g., the young and the elderly, and is often a matter of great frustration to those who do have good manual dexterity but who are hurrying and hence may be less careful.

The present invention provides a jewelry clasp, particularly for necklaces, that can be operated merely by pushing a conventional jump ring into a slot. Once the slot is located, merely the action of pushing the jump ring into the slot automatically opens the clasp to receive and secure the jump ring.

Thus, the present invention provides a jewelry clasp for releasably securing a jump ring thereto, comprising a housing having top, bottom and side edges, and parallel elongated faces, said top edge having an aperture therein, and an elongated slot means in said faces for receiving a jump-ring, said slot having an opening in one of said side edges; a latching member in said housing having a base portion adjacent said bottom edge, a first leg extending from said base and through said aperture and terminating in a clasp-release actuator outside said housing, and a second leg spaced from said first leg and normally extending from said base across the width of said slot to close said slot opening, said second leg being of a size to fit inside a jump ring and having a cam surface adjacent to and facing said slot opening, said cam surface being inclined away from said slot opening toward said top edge; and biasing means urging said latching member fo a normal position in which said first leg is out of said housing and said second leg closes said slot; said cam surface being operable, when a jump ring is inserted in said slot and forced against said cam surface, to force said latching member toward said bottom edge against the bias of said resilient means to thus gradually open said slot and permit full entry of the jump ring into said slot, and said latching member being operable to return to its normal position under the bias of said resilient means when the jump ring has fully entered the slot and no longer contacts said leg, thereby inserting said second leg into said jump ring; said latching member being operable, when said actuator is manually depressed against the bias of said resilient means, to open said slot and thus permit removal of said jump ring.

The present invention is illustrated in terms of a preferred embodiment in the accompanying drawing, in which.

Figure 1:
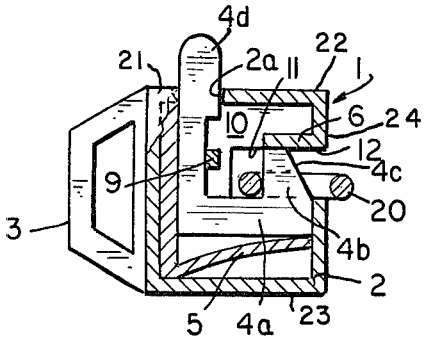
FIG. 1 is an elevational view in section, which illustrates the jewelry clasp of the invention in its normally closed position.

Referring to FIG. 1, the jewelry clasp 1 comprises a housing 2 having a ring 3 attached thereto. Ring 3 is secured to one end of a chain (not shown) of a necklace or bracelet. Within housing 2 is a latching member 4 having a base 4*a*, a short leg 4*b* having a cam surface 4*c*, and a longer leg passing through aperture 2*a* in the top edge of housing 2 and terminating in an actuator 4*d* outside housing 2. Housing 2 has a front face 21 identical to back face 10.

Within the housing 2 is a spring 5 bearing against the base 4*a* of the latching member 4 and urging the latching member upwardly as shown in the drawing to its normal position (FIG. 1). Spring 5 rests on the bottom edge 23 of housing 2 cut into the front face 21 and back face 10 of the housing 2 is an elongated slot 11 having its opening 12 in the side edge 24 of housing 2. Slot 11 is of a size to accomodate a jump ring 20. Jump ring 20 will normally be connected to the other end of the chain (not shown) connected to ring 3.

Stop member 6 extends from the opening 12 into the housing 2 along the top portion of the slot 11 as viewed in the drawing, and also extends between the front face 21 and back face 10 of the housing. When the latching member is in its normally locked position, the leg 4*b* abuts against the underside of stop member 6. This not only limits the movement of the latching member 4 under the bias of spring 5, but, in addition, the leg 4*b* and the stop member 6 cooperate to prevent the jump ring 20 from lifting off of leg 4*b* and slipping out of slot 11 through opening 12.

Figure 2:
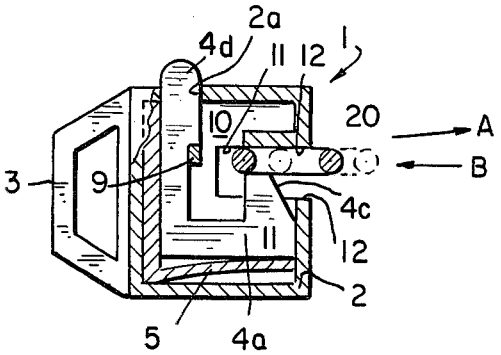
FIG. 2 is an elevational view in section illustrating the operation of the clasp of FIG. 1.

FIG. 2 illustrates the clasp 1 in the normally locked position. Removal is effected by manually depressing the actuator 4*d* downwardly as viewed in the drawing, which lowers leg 4*b* to thus open slot 11 from which the jump ring 20 may be removed by lifting up the jump ring 20 and sliding it in the direction of arrow A as shown in FIG. 2. Stop 9 limits the downward travel of the latching member 4.

FIG. 2 also illustrates how the jump ring 20 is inserted into the clasp 1. With the clasp in the locked position of FIG. 1, the jump ring 20 is placed through the opening 12 of slot 11 into contact with cam surface 4*c*. When the jump ring 20 is pushed against the cam surface 4*c* in the direction of arrow B (FIG. 2), the jump ring will initially ride up to the top of slot 11, and further pushing of the jump ring 20 against cam surface 4*c* in the same direction will force the latching member 4 downwardly as viewed in FIG. 2 against the bias of spring 5. FIG. 2 shows the jump ring 20 just before it leaves contact with leg 4*b*. When the jump ring is moved further in the direction of arrow B, it will no longer contact the leg 4*b*, and the spring 5 will thus urge latching member 4 upwardly, as viewed in FIG. 2, with leg 4*b* passing through the jump ring 20. The final, locked position is shown in FIG. 1.

This procedure is readily accomplished by any person of even limited dexterity, since the latching operation requires merely pushing the jump ring 20 into slot 11 against cam surface 4*c*; the cam surface 4*c* then automatically locks the clasp to admit the jump ring 20 into the slot 11. Similarly, unlocking the clasp for removal of the jump ring 20 is effected by a single finger manually depressing actuator 4*d*.

Figure 3:
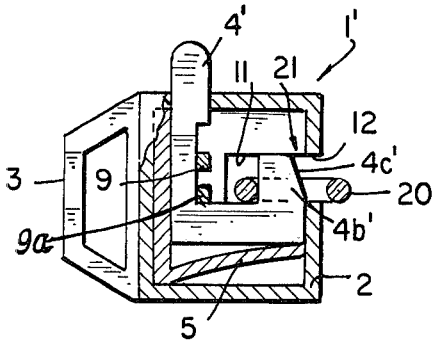
FIG. 3 is a view similar to FIG. 1 of another embodiment of the invention.

FIG. 1 illustrates the presently preferred embodiment of the invention. FIG. 3 illustrates another embodiment in which the clasp 1′ is identical to clasp 1 except that stop member 6 has been removed and leg 4*b* is spaced from slot 12 such that the widest distance 21 between cam surface 4*c*′ and the housing 2 is smaller than the cross-section of jump ring 20 to prevent the jump ring 20 from falling out of the clasp 1′. Stop 9*a* limits the upward movement of the latching member 4′. If desired, stops 9 and 9*a* can be combined for ease of manufacture.

The clasp 1 is economically manufactured by using stamped blank from which the housing 2 and ring 3 are erected. Jump ring 20 is conventional, and no custom work need be done. The latching member 4 may also be stamped, for economy. Spring 5 is an inexpensive leaf spring. Thus, an easy-to-use and inexpensive clasp is provided.

I claim:

1. A jewelry clasp for releasably securing a jump ring thereto, comprising a housing having top, bottom and side edges, and parallel elongated faces, said top edge having an aperture therein, and an elongated slot means in said faces for receiving a jump-ring, said slot means having a top portion adjacent the top edge of said housing, a bottom portion located between said top portion and said bottom edge of the housing and an opening in one of said side edges; a latching member in said housing having a base portion adjacent said bottom edge, a first leg extending from said base and through said aperture and terminating in a clasp-release actuator outside said housing, and a second leg spaced from said first leg and normally extending from said base across the width of said slot to close said slot opening, said second leg being of a size to fit inside a jump ring and having a cam surface adjacent to and facing said slot opening, said cam surface being inclined away from said slot opening toward said top edge; biasing means urging said latching member to a normal position in which said first leg is out of said housing and said second leg closes said slot; and a stop member is provided extending from said slot opening into said housing along said top portion of said slot, said second leg terminating in a surface abutting said stop member when said latching member is in said normal position, said stop member and said second leg cooperating to close said slot opening when the latching member is in its normal position; said cam surface being operable, when a jump ring is inserted in said slot and forced against said cam surface, to open said slot by moving said latching member toward said bottom edge against the bias of said biasing means and thus gradually move said surface of said second leg away from said stop member; and said latching member being operable to return to its normal position under the bias of said biasing means when the jump ring has fully entered the slot and no longer contacts said second leg, thereby inserting said second leg into said jump ring; said latching member being further operable, when said actuator is manually depressed against the bias of said biasing means, to open said slot and thus permit removal of said jump ring.

2. The clasp according to claim 1, wherein means for limiting the movement of said latching member against the bias of said biasing means is provided within said housing.

* * * * *